United States Patent [19]

Achelpohl

[11] Patent Number: 4,606,537

[45] Date of Patent: Aug. 19, 1986

[54] APPARATUS FOR STACKING FLAT ARTICLES

[75] Inventor: Fritz Achelpohl, Lengerich, Fed. Rep. of Germany

[73] Assignee: Windmoller & Holscher, Lengerich, Fed. Rep. of Germany

[21] Appl. No.: 788,697

[22] Filed: Oct. 21, 1985

Related U.S. Application Data

[63] Continuation of Ser. No. 499,356, May 31, 1983, abandoned.

[30] Foreign Application Priority Data

Jun. 3, 1982 [DE] Fed. Rep. of Germany ..... 3220946

[51] Int. Cl.[4] ..... B65H 29/40

[52] U.S. Cl. ..... 271/196; 271/95; 414/27; 414/80

[58] Field of Search ..... 271/91, 92, 95, 903, 271/194, 196; 414/27, 80, 121

[56] References Cited

U.S. PATENT DOCUMENTS

| | | | |
|---|---|---|---|
| Re. 27,523 | 11/1972 | Maccherone | 414/80 X |
| 3,937,457 | 2/1976 | Schwebel | 414/121 X |
| 4,286,907 | 9/1981 | Houle et al. | 414/27 X |

FOREIGN PATENT DOCUMENTS

| | | |
|---|---|---|
| 2332925 | 1/1974 | Fed. Rep. of Germany . |
| 32165047 | 10/1983 | Fed. Rep. of Germany . |

*Primary Examiner*—Robert J. Spar
*Assistant Examiner*—Janice Krizek
*Attorney, Agent, or Firm*—Fleit, Jacobson, Cohn & Price

[57] ABSTRACT

In stacking apparatus for flat articles such as flattened bags, radial arms mounted on each of two spaced hubs and having suction nozzles at their leading sides place the articles onto needles. The arms are rotatable about their longitudinal axes. They can be turned outwards through an acute angle by cam and cam follower means and are turned back after the articles have been placed on the needles.

5 Claims, 4 Drawing Figures

APPARATUS FOR STACKING FLAT ARTICLES

This application is a continuation of application Ser. No. 499,356, filed May 31, 1983, now abandoned.

The invention relates to an apparatus for stacking flat articles such as tube sections, bags or the like, comprising two spaced hubs which rotate synchronously about a horizontal axis and carry radial arms arranged in star formation at equal angular spacings, the leading sides of the arms being equipped with suction nozzles, depositing or supporting means for the arriving articles which are disposed between the arms in the region of the horizontal plane containing the axis, the articles projecting laterally beyond the said means so that their side edges at least partially intersect the planes of rotation of the arms, and one or more substantially vertical needles, needle rows or the like which are disposed between the planes of rotation of the arms on the side of the axis opposite to the depositing means, are spaced from the arms and onto which the arms push the articles that have been removed from the depositing means, have been provided with perforated margins or strips and have been inverted.

In known apparatus of this kind of which the basic construction is, for example, known from DE-OS No. 23 32 925, the articles removed by the arms from the depositing means, which usually consist of transfer rakes, can curve during their semi-circular passage to the rows of needles, whereby the holes of the perforations will no longer be in registry with the needles and disruptions will occur.

In an apparatus of the aforementioned kind known from prior Patent Application P No. 32 16 504.8, the confronting sides of the arms have suction orifices below a supporting plane defined by every two cooperating arms. They hold the flat articles substantially taut between the arms so that curving or flapping of the articles is substantially avoided and they can be properly placed on the needles to form a stack.

It is an object of the present invention to provide a further arm construction for an apparatus of the aformentioned kind to facilitate stacking by holding the flat articles as taut as possible while they are being transferred.

According to the invention, this object is attained in that the arms at least on one side are mounted on the hub for rotation about their longitudinal axis and means are provided for turning the arms outwardly through an acute angle after they have passed through the depositing or supporting means, and that the arms are turned back to their starting position after the articles have been pushed on the needles or the like. By means of turning at least one of the arms carrying the flat articles in the apparatus according to the invention, the articles are uniformly wound onto the arms to a small extent, whereby they are pulled taut and accurate and trouble-free placing on the needles is facilitated.

Advantageous embodiments of the invention have been described in the subsidiary claims.

One example of the invention will now be described in more detail with reference to the drawing, wherein.

Figure 1:
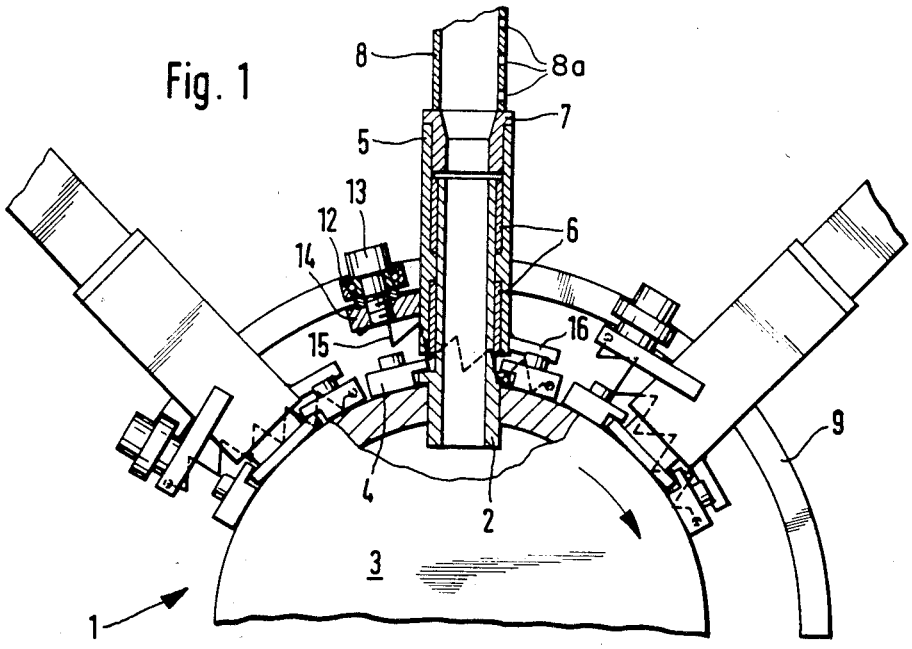
FIG. 1 is a part-sectional side elevation of the hub region of the apparatus.
Figure 2:
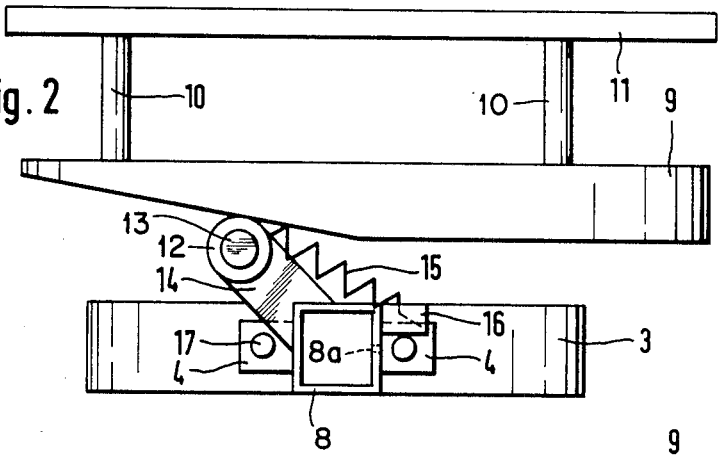
FIG. 2 is a plan view of the cam for turning the arms and the control lever disposed in the vicinity of the cam.
Figure 3:
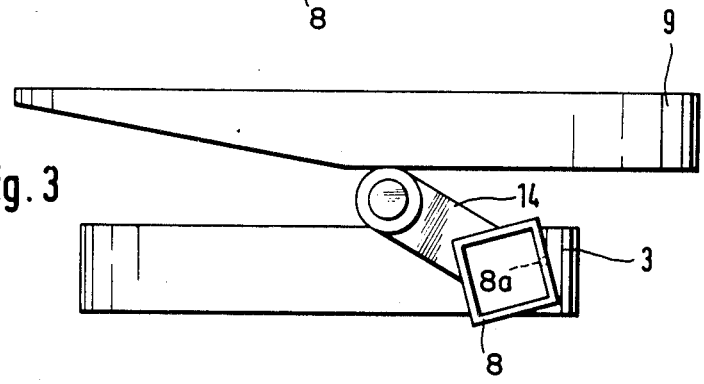
FIG. 3 is a view similar to FIG. 2 with the control lever having swung the arm to its outwardly turned limiting position.
Figure 4:
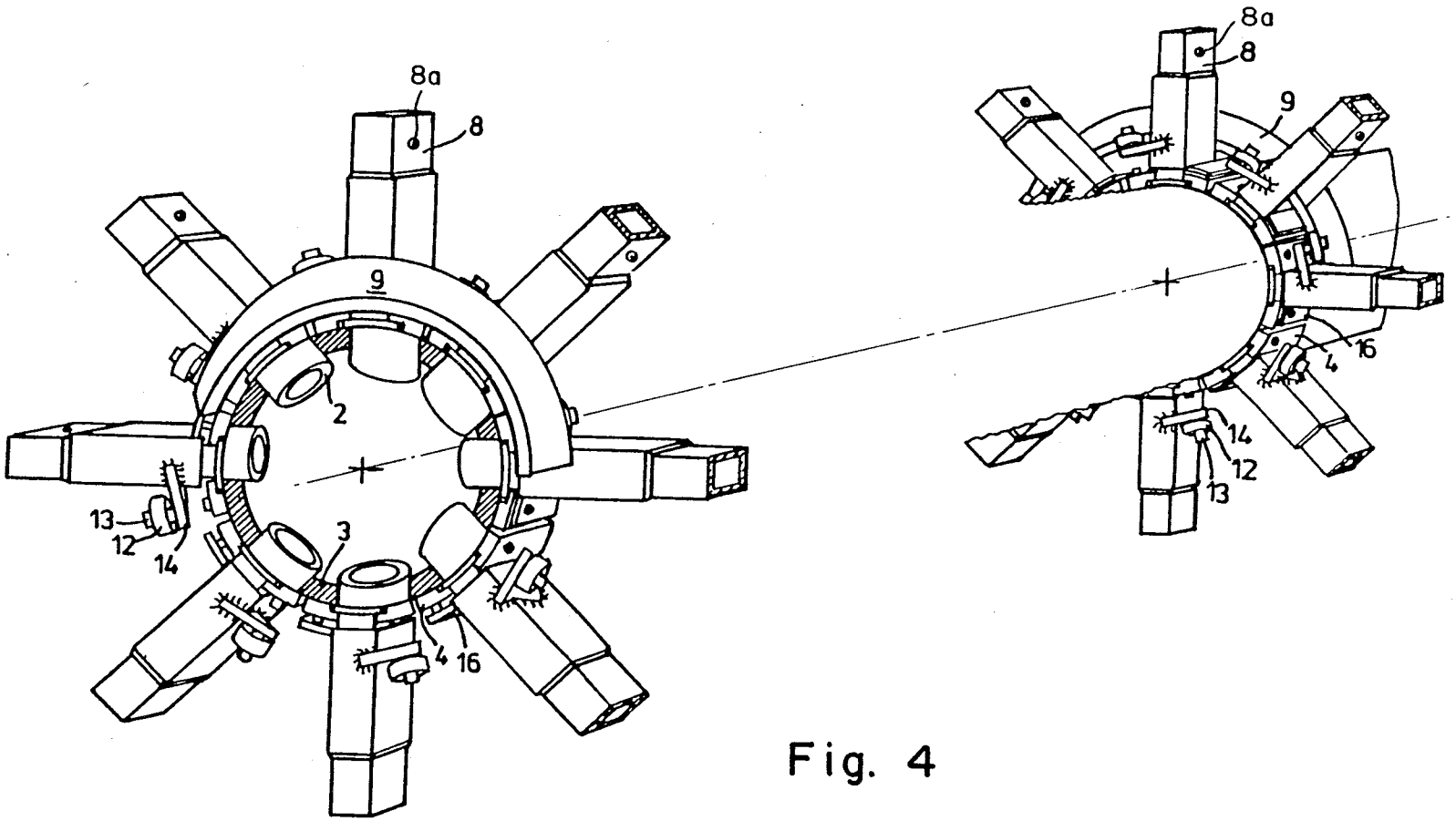
FIG. 4 is a perspective view showing a rotatable spoked wheel in accordance with the invention and having two spaced rows of radial spokes.

For the basic construction of the apparatus for stacking flat articles, attention is drawn to FIGS. 1 and 2 and the associated description of prior Patent Application P No. 32 16 504.8.

FIG. 1 illustrates the hub 3 of the spoked wheel carrying the suction arms 8. The wall of the spoked wheel 1 is provided with holes in which nipple-like tubular insert members 2 are inserted. Each tubular insert member 2 is held to the hub 3 by a clamping member 4 which is screwed onto it from the outside. A further tube member 5 is pushed onto each insert member 2 and held thereon by bearing bushes 6. An adaptor member 7 is inserted and secured in the end of tube 5 furthest from the hub 3. The member 7 is hollow and carries the suction arm 8 which is square in cross-section. The suction arm 8 has suction apertures **8*a*** only at its leading side for suction-attracting the flat workpiece to be deposited.

To permit tensioning of a workpiece engaged by two parallel suction arms 8 juxtaposed at a spacing, at least the suction arms 8 of one of the two parallel spoke wheels can be rotated by way of a cam 9. This cam 9 is connected to the machine frame 11 by securing bolts 10. A ball bearing 12 runs along this cam 9 during rotation of the spoke wheel 1 and it is connected to a control lever 14 by a bolt 13. This lever 14 is welded to the tube 5. A tension spring 15 engaging the lever 14 has its other end connected to one of the two clamping members 4. By means of this spring 15, the abutment 16 towards the stop 17 defined by the head of the bolt which connects the clamping member 4 adjacent to abutment 16 to the hub 3.

As will be evident from FIG. 1, spring 15 extends obliquely downwardly from lever 14 so that the tube 5 is pulled tight over the tubular insert member 2 and special means can be dispensed with for holding the tube 5 in the axial direction.

I claim:

1. Apparatus for carrying flat articles such as tube sections, bags or the like, comprising:

a rotatable spoked wheel having at least one row of first radial arms arranged in star formation at equal angular spacings, a row of second radial arms arranged in star formation at equal angular spacings, said row of second radial arms spaced from said row of first radial arms along an axis of rotation for gripping an article, the sides of the arms of said row of first radial arms being equipped with at least one row of radially aligned suction apertures on a side facing in the direction of rotation of the wheel for communication with a source of suction for holding a flat article, the arms of said row of first radial arms being mounted on the wheel for rotation about their longitudinal axes, means for rotating the rotatable arms about their longitudinal axes through an acute angle in a direction away from said row of second radial arms after the rotatable arms have passed a first predetermined point in the path of rotation of the wheel to draw the flat articles taut between first and second radial arms for positive and accurate conveyance of the articles to a predetermined position when the apertures in said first radial arms are in communication with a source of suction, and means for rotating the arms back to their starting positions after the rotatable arms have passed a second predetermined point in the path of rotation of the wheel to release the tension in the articles and deposit them at a predetermined position.

2. Apparatus according to claim 1, wherein the radial arms include tubular inserts secured to the wheel, tubular members rotatably carried concentrically on the outside of the tubular inserts, control levers secured to the tubular members, a stationary cam surface, cam followers running on the stationary cam surface, an abutment member connected to each of the tubular members, stop means carried on the wheel to limit rotation of the tubular member, and a spring for carrying the abutment member on the tubular members towards the stop means.

3. Apparatus according to claim 2, wherein the means for rotating the arms back to their starting position includes a spring that is a tension spring extending obliquely from a free end of the control lever, which free end is radially spaced outwardly from and adjacent to the outer surface of the wheel.

4. Apparatus according to claim 1, wherein the arms are of rectangular cross section.

5. Apparatus according to claim 1, wherein the arms are of square cross section.

* * * * *